US007326845B2

(12) United States Patent
Nakaya

(10) Patent No.: US 7,326,845 B2
(45) Date of Patent: Feb. 5, 2008

(54) MUSIC STAND DEVICE AND MUSICAL INSTRUMENT HAVING THE MUSICAL STAND DEVICE

(75) Inventor: Hiroki Nakaya, Jakarta (ID)

(73) Assignee: Yamaha Corporation, Hamamatsu-shi (JP)

( * ) Notice: Subject to any disclaimer, the term of this patent is extended or adjusted under 35 U.S.C. 154(b) by 22 days.

(21) Appl. No.: 11/237,312

(22) Filed: Sep. 27, 2005

(65) Prior Publication Data

US 2006/0070509 A1 Apr. 6, 2006

(30) Foreign Application Priority Data

Sep. 27, 2004 (JP) ..... 2004-280238

(51) Int. Cl.
*G10D 15/02* (2006.01)

(52) U.S. Cl. ..... 84/472

(58) Field of Classification Search ..... 84/472, 84/478, 453; 206/314; 248/443

See application file for complete search history.

(56) References Cited

U.S. PATENT DOCUMENTS

2004/0182223 A1* 9/2004 Kuwahara et al. ..... 84/423 R

FOREIGN PATENT DOCUMENTS

JP 9-114448 5/1997

* cited by examiner

*Primary Examiner*—Kimberly Lockett
(74) *Attorney, Agent, or Firm*—Morrison & Foerster LLP

(57) ABSTRACT

A music stand device can be securely mounted in a keyboard instrument or the like. A music score plate holds a musical score. A mounting member is mounted on a roof plate. A fixing member is fixed to the musical score plate and has one end thereof rotatably supported by one end of the mounting member. A supporting member has one end thereof rotatably supported by the other end of the fixing member and the other end thereof engaged by a part of the mounting member to thereby maintain the musical score plate in the standing position. An engaging bolt is provided in the roof plate and located in opposed relation to the mounting member. The mounting member is slid to engage an engaging hole and the engaging bolt with each other, with the mounting member fastened to the roof plate by a fastening tool from above through fastening holes.

6 Claims, 3 Drawing Sheets

MUSIC STAND DEVICE AND MUSICAL INSTRUMENT HAVING THE MUSICAL STAND DEVICE

BACKGROUND OF THE INVENTION

1. Field of the Invention

The present-invention relates to a music stand device provided in a keyboard instrument or the like, and a musical instrument having the music stand device.

2. Description of the Related Art

Conventionally, there has been known a music stand device constructed such that a musical score plate is disposed in a standing position on a base such as a roof plate of a musical instrument (see Japanese Patent Publication No. 3317109, for example). This apparatus includes a mounting plate that is fixed to the base, a fixing plate that is fixed to the musical score plate, and a supporting plate that is pivotally supported at an upper end of the fixing plate, with a free end of the supporting plate engaged by the mounting plate. Thus, these three members form a triangular shape as viewed from the side to keep the musical score plate slightly tilted backward in a standing position. The mounting plate is secured to the base by screws or the like.

In the music stand device disclosed in Japanese Patent Publication No. 3317109 mentioned above, the mounting plate is typically fastened to the base from above using a hand tool such as a screwdriver, but an upper end of the musical score plate in a standing position lies above the fastening part. Therefore, in this state, the hand tool and the musical score plate are likely to interfere with each other, making it difficult to carry out the fastening operation. To avoid the interference, the musical score plate has to be temporarily raised forward. Accordingly, to prevent a lower end face of the musical score plate in a standing position (i.e. a front end face of the musical score plate when it is laid down) from interfering with the base, it is necessary to provide an appropriate space between the lower end face of the musical score plate and the base. This causes the problem that a finger or foreign matter is caught in this space when the mounting plate is fastened to the base or when the musical score plate is brought into a standing position or a laid-down position and therefore safety cannot be secured and the musical instrument does not look attractive as viewed from the front.

Alternatively, assuming that the mounting plate is sufficiently long in the longitudinal direction of the apparatus and the fastening part is located in a rear part of the mounting plate, the hand tool and the musical score plate can be prevented from interfering with each other during the fastening operation, but the operatability deteriorates due to an increase in the size of the mounting plate, and also, the mounting plate cannot be securely fixed to the base due to a decrease in the fixing strength of mainly a front part of the mounting plate fixed to the base.

Also, in the music stand device disclosed in Japanese Patent Publication No. 3317109 mentioned above, a musical score resting member is disposed on the roof plate as the base, and hence a musical score is positioned relatively high, leaving room for improvement in viewability.

By the way, in a keyboard instrument equipped with a retractable slide cover that is slid forward and backward, the retractable slide cover is designed to hide the interior of the main body of the musical instrument from view when the cover is closed. This, however, causes the problem that the retractable slide cover is long in the longitudinal direction of the instrument, and as a result, to secure a required space for accommodating the retractable slide-cover when it is opened, the main body of the musical instrument has to be long in the longitudinal direction of the instrument. On the other hand, if there is additionally provided a member exclusively for hiding the interior of the main body of the keyboard instrument from view, the musical instrument will be complicated in construction and will not look attractive.

SUMMARY OF THE INVENTION

It is a first object of the present invention to provide a music stand device that can be securely mounted in a keyboard instrument or the like in a safe manner and with ease and improve the appearance of the keyboard instrument or the like, and a musical instrument having the music stand device.

It is a second object of the present invention to provide a music stand device that is capable of holding a musical score low in an appropriate state so that it can be easy to view, and a musical instrument having the music stand device.

It is a third object of the present invention to provide a music stand device and a musical instrument having the music stand device that enable a musical score resting member to perform the function of hiding the interior of the main body of a keyboard instrument or the like equipped with a retractable slide cover from view to thereby reduce the depth of the main body of the keyboard instrument and improve the appearance of the keyboard instrument or the like without complicating its construction.

To attain the first object, in a first aspect of the present invention, there is provided a music stand device for a musical instrument, comprising a music score plate that holds a musical score on a musical score holding surface thereof while being tilted backward in a standing position a mounting member mountable on a roof plate of the musical instrument, and having one end, a fixing member fixed to the musical score plate and having one end thereof rotatably supported by the one end of the mounting member, the fixing member having another end, a supporting member having one end thereof rotatably supported by the other end of the fixing member and having another end thereof engaged by a part of the mounting member to thereby maintain the musical score plate in the standing position, and an engaging member that is provided in the roof plate in opposed relation to the mounting member, wherein the musical score plate has a lower end surface thereof in the standing position thereof disposed at an acute angle to the musical score holding surface, and the mounting member comprises an engaged part provided in association with the engaging member and engageable with the engaging member to temporarily fix the mounting member to the roof plate, and at least one fastening part provided in a rear part of the mounting member at a location rearward of the engaged part, for fastening the mounting member to the roof plate by a fastening tool, and the mounting member is slid while the musical score plate is held in the standing position, to engage the engaged part and the engaging member with each other, and then the mounting member is fastened to the roof plate by the fastening tool from above through the fastening part.

With the arrangement of the first aspect of the present invention, the mounting member can be easily attached to the roof plate because the mounting member is slid and temporarily fixed to the roof plate and then fastened to the roof plate by the fastening tool from above through the fastening part. Also, it is unnecessary to temporarily raise the musical score plate to the front during the fastening operation because the fastening part are located in the rear part of the mounting member. Thus, the lower end face of the musical score plate in the standing position and the musical score holding surface make an acute angle with each other, and the space (S1) between the lowest end of the musical score holding surface and the upper end of the roof plate can be made small. Since the musical score does not have to be temporarily raised to the front and the space can be small, a finger or foreign matter will be never caught in the space during the fastening operation or when the musical score plate is brought into a standing position or a laid-down position, so that the mounting member can be attached to the roof plate in a safe manner and with ease. Making the space small also improves the appearance. Further, since the engaging member and the engaged part are engaged with each other in an area ahead of the fastening part to temporarily fix the mounting member to the roof plate, the mounting member can be fixed to the roof plate in a more stable state as compared with the case where the mounting member is fixed only at the fastening part. As a result, the mounting member can be securely attached to the roof plate in a safe manner and with ease, and the appearance of the keyboard instrument or the like can be improved.

To attain the second object, in a second aspect of the present invention, there is provided a musical instrument having a music stand device, comprising a roof plate having a front part, a front plate extending aslant, i.e. forward and downward from the front part of the roof plate, the front plate having a front surface, and a musical score plate provided in the music stand device, the musical score plate being mounted in a standing position on the front part of the roof plate, the musical score plate having a front surface, and a musical score resting member provided at a lower level than the roof plate, for holding a lower end of a musical score, wherein the front surface of the front plate and the front surface of the musical score plate are flush with each other and cooperate with each other to hold a back surface of the musical score.

With the arrangement of the second aspect of the present invention, since the musical score resting member is located at a lower level than the roof plate, the musical score can be held low. Since the front surface of the front plate and the front surface of the musical score plate are flush with each other and cooperate with each other to hold the back surface of the musical score, the surface that holds the musical score is flat without any stepped part, and hence the musical score can be held in an appropriate state and the appearance can be made good. As a result, it is possible to hold the musical score in an appropriate state at a low level and at an easy-to-view position. Also, the appearance can be improved.

Preferably, the musical score resting member has a musical score abutment surface on which the musical score is to abut, and wherein the musical score abutment surface is disposed substantially at right angles to the front plate to prevent slippage of the musical score.

To attain the third object, in a third aspect of the present invention, there is provided a musical instrument having a music stand device, comprising a retractable slide cover that is opened and closed by sliding forward and backward, the slide cover having a rear part, a roof plate having a front part, a front plate extending aslant, i.e. forward and downward from the front part of the roof plate, the front plate having a lower part, and a musical score resting member provided at such a location as to bridge the rear part of the retractable slide cover and the lower part of the front plate when the retractable slide cover is closed, for holding a lower end of a musical score.

With the arrangement of the third aspect of the present invention, since the musical score resting member is provided at such a location as to bridge the rear part of the retractable slide cover and the lower part of the front plate, the musical score resting member cannot only hold the lower end of the musical score but also hide the interior of the main body of the keyboard instrument from view. As a result, the retractable slide cover does not have to be long in the longitudinal direction thereof, and therefore the space for accommodating the retractable slide cover when it is opened can be small, reducing the depth of the main body of the keyboard instrument. Also, the construction can be simplified and advantageous in terms of design as compared with the case where there is provided a member exclusively for hiding the interior of the musical instrument body from view. Since the musical score resting member is able to perform the function of hiding the interior of the main body of the keyboard instrument from view, the depth of the musical instrument body equipped with the retractable slide cover can be shorter, and the appearance of the keyboard instrument or the like can be improved without complicating the construction.

Preferably, the musical score resting member has a musical score abutment surface on which the musical score is to abut, and wherein the musical score abutment surface is disposed substantially at right angles to the front plate to prevent slippage of the musical score.

The above and other objects, features, and advantages of the invention will become more apparent from the following detained description taken in conjunction with the accompanying drawings.

DETAILED DESCRIPTION OF THE PREFERRED EMBODIMENTS

The present invention will now be described in detail with reference to the drawings showing a preferred embodiment thereof.

Figure 1A:
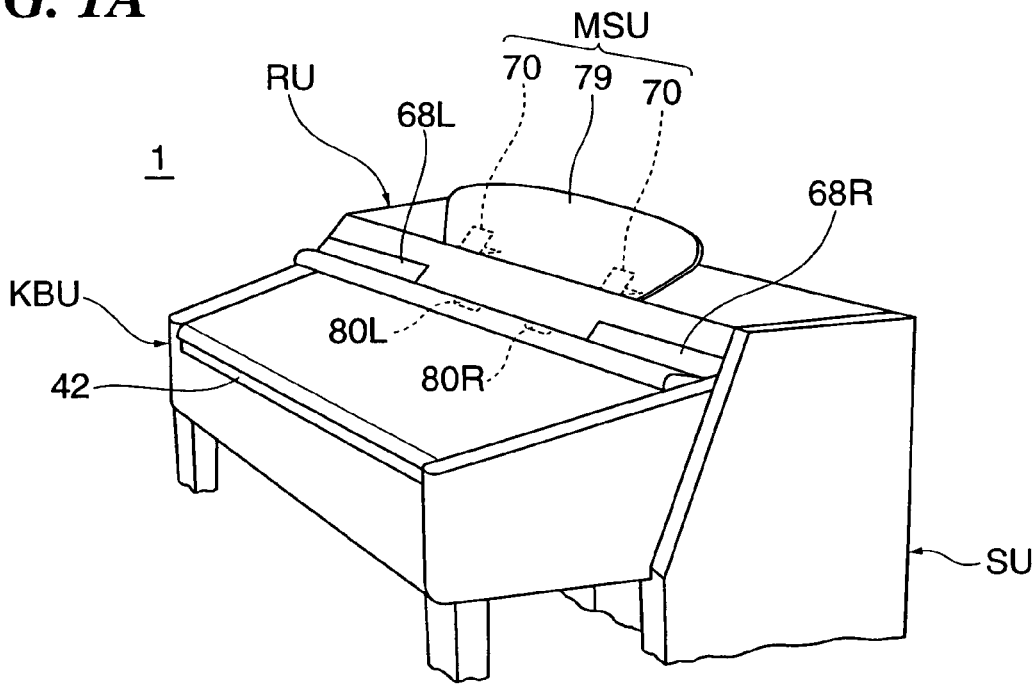
FIG. 1A is a perspective view showing the upper half of a keyboard instrument as a musical instrument having a music stand device according to an embodiment of the present invention is applied.
Figure 1B:
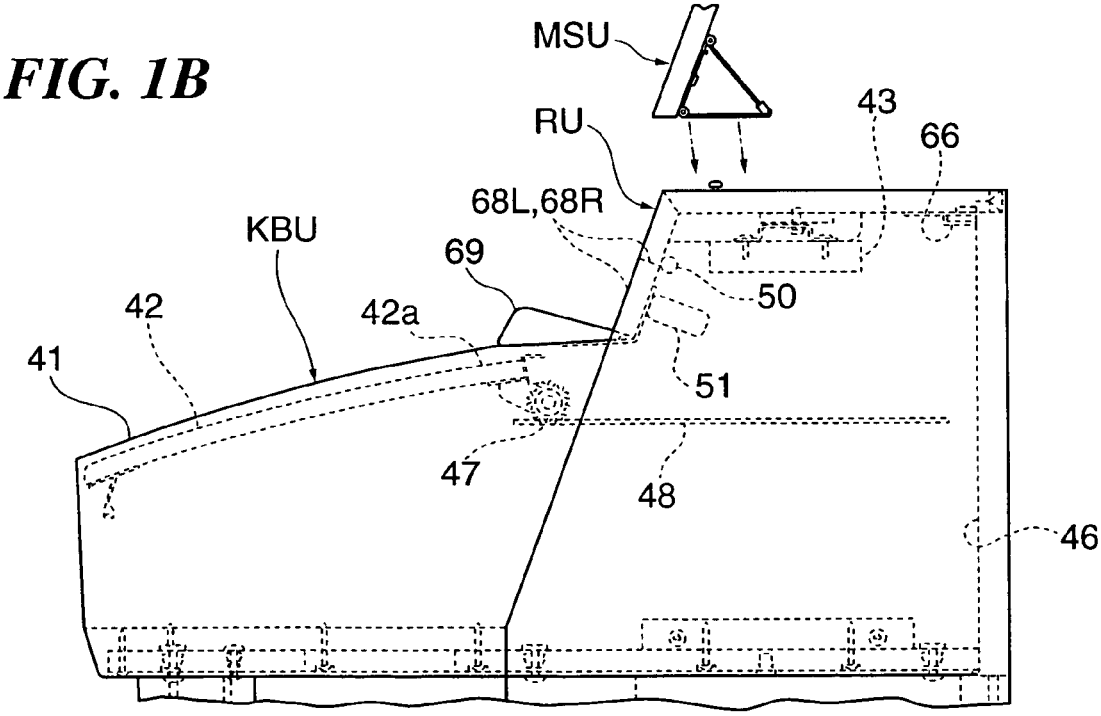
FIG. 1B is a right side view showing the upper half of the keyboard instrument.
Figure 2:
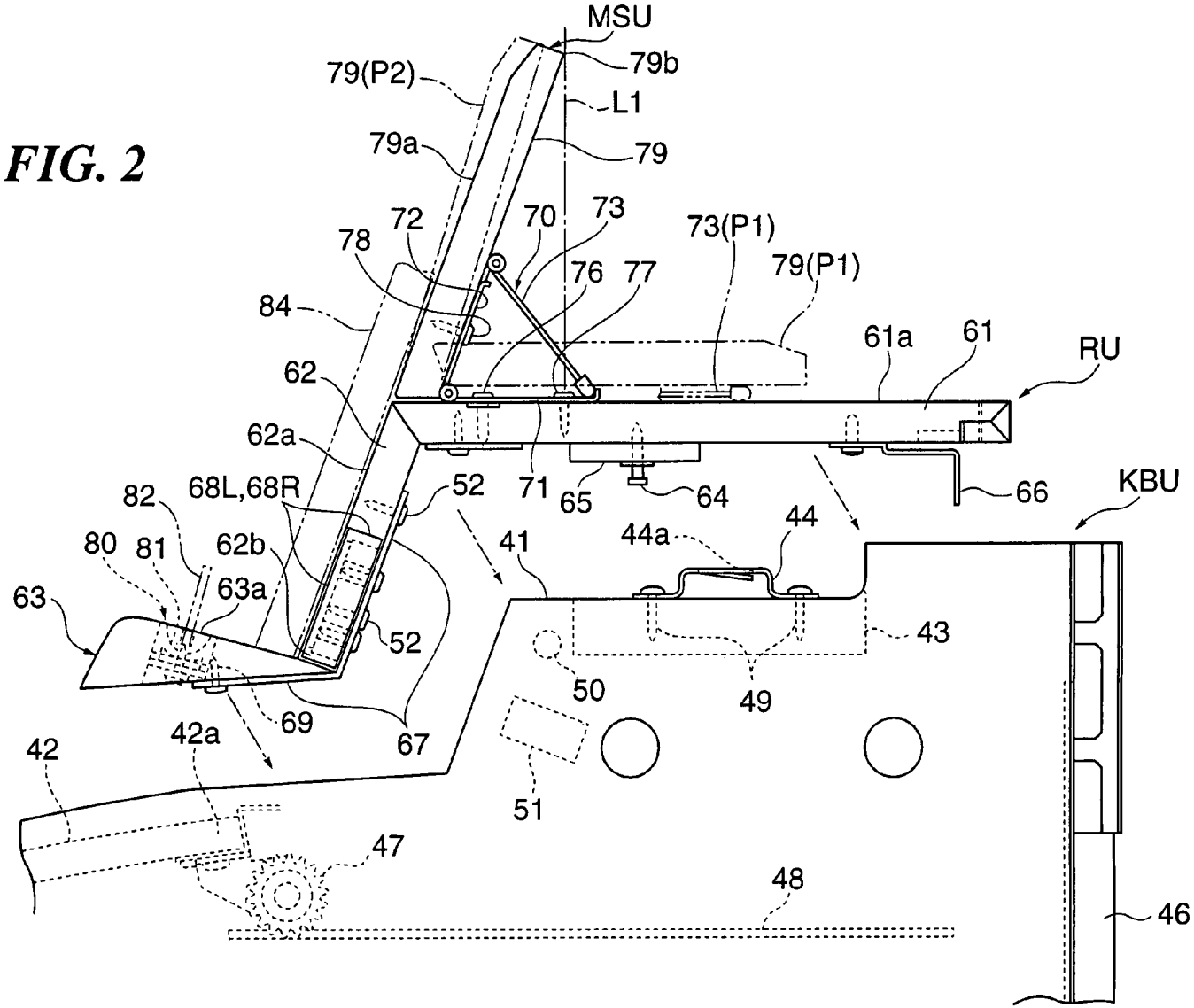
FIG. 2 is an exploded view showing a keyboard instrument main body and a roof unit.

FIG. 1A is a perspective view showing the upper half of a keyboard instrument as a musical instrument having a music stand device according to an embodiment of the present invention is applied. FIG. 1B is a right side view showing the upper half of the keyboard instrument 1. FIG. 2 is an exploded view showing a keyboard instrument main body KBU and a roof unit RU.

The keyboard instrument 1 is generally comprised of the keyboard instrument main body KBU, the roof unit RU, and a support unit SU on which the keyboard instrument main body KBU and the roof unit RU are mounted. A music stand unit MSU is attached to the roof unit RU. In the following description, the directions of the depth and width of the keyboard instrument 1 and the musical stand unit MSU represent those as viewed from a player in the state in which the music stand unit MSU is attached to the roof unit RU.

The keyboard instrument main body KBU is comprised of side plates 41 equivalent to angle plates arranged on right and left sides thereof, a back plate 46 that joins together rear parts of the right and left side plates 41, a keyboard, not shown, disposed between the right and left side plates 41, and a cover 42 for covering the keyboard. In the keyboard instrument main body KBU, the right side and the left side are symmetric and identical in construction with each other. FIGS. 1B and 2 illustrate the construction of only the right side.

As shown in FIG. 2, in the keyboard instrument main body KBU, one pinion gear 47 is attached to each of the right and left sides of a rear part 42*a* of the cover 42. Also, one rack 48 that is engaged with each pinion gear 47 is provided in a rear half part of the keyboard instrument main body KBU (see FIG. 1B as well). The cover 42 is a retractable sliding type; when the cover 42 is urged forward or backward, the pinion gears 47 roll on the racks 48 engaged therewith so that the cover 42 can move frontward or backward.

As shown in FIGS. 1B and 2, abutment members 50 and 51, on which a front plate 62, described later, of the roof unit RU is to abut, and fixing members 43 are fixed on the inside surfaces of both the side plates 41. As shown in FIG. 2, roof unit mounting brackets 44 for mounting the roof unit RU are attached to the fixing members 43.

Retaining holes 44*a* that are elongated in the longitudinal direction of the keyboard instrument main body KBU are formed in upper surfaces of the roof unit mounting brackets 44. Each retaining hole 44*a* has a front part thereof being wider, although not illustrated in detail. The upper surface of each roof unit mounting bracket 44 progressively lowers as it goes rearward (see FIG. 2). An engaging bolt 64, described later, is engaged with each retaining hole 44*a* to take part in fixing the roof unit RU to the keyboard instrument main body KBU.

As shown in FIG. 2, the roof unit RU is comprised of a roof plate 61 and the front plate 62 which are configured as an integral unit. The front plate 62 extends aslant, i.e. forward and downward from the front side of the roof plate 61, and a musical score resting member 63 is attached to the bottom of the front plate 62. The engaging bolts 64 associated with the respective roof unit mounting brackets 44 are attached via spacers 65 to respective lower surfaces of the roof plate 61 at right and left sides thereof. Fixing brackets 66 are attached to respective lower surfaces of rear parts of the roof plate 61 at the right and left sides thereof. Further, a half of a fastening bracket 67 that is substantially L-shaped as viewed from the side is fixed to a rear surface of a lower part 62*b* of the front plate 62 by two screws 52, and the musical score resting member 63 is fixed at a lower surface thereof to the other half of the fastening fixture 67 by a screw 69. The musical score resting member 63 plays a role of holding a lower end of a musical score 84. Together with the holding by the musical score resting member 63, a musical score holding surface 79*a* of a musical score plate 79 and a front surface 62*a* of the front plate 62 cooperate with each other to hold a back surface of the musical score 84 (see FIG. 2).

As shown in FIG. 1B, with the cover 42 closed, the musical score resting member 63 is located at such a location as to bridge the rear part 42*a* of the cover 42 and the lower part 62*b* of the front plate 62 to hide the interior of the keyboard instrument main body KBU from view. Therefore, it is possible to shorten the length of the cover 42 in the longitudinal direction thereof without extending the rear part 42*a* of the cover 42 rearward for the purpose of hiding the interior of the keyboard instrument main body KBU from view, and hence the space for accommodating the cover 42 when it is open can be small, reducing the depth or longitudinal size of the keyboard instrument main body KBU. Also, since the musical score resting member 63 also serves to hold the lower end of the musical score 84, the construction is less complicated as compared with the case where there is provided a member exclusively for hiding the interior of the keyboard instrument main body KBU from view. Further, a musical score abutment surface 63*a*, i.e. an upper surface of the musical score resting member 63, on which the musical score 84 is to abut, is disposed substantially at right angles to the front plate 62 attached aslant to the roof plate 61 such that the musical score 84 can be prevented from slipping. With this arrangement, the musical score resting member 63 progressively increases in thickness (height) as it goes frontward, and therefore it looks attractive as viewed from the front.

Also, the musical score resting member 63 is located at a substantially lower level than the upper surface 61*a* of the roof plate 61, and the musical score 84 can be held the lower. Therefore, the musical score 84 can be held at a low and easy-to-view position as compared with the case where the musical score resting member 63 is provided on the upper surface 61*a* of the roof plate 61 or the like.

The retaining hole 44*a* of each roof unit mounting bracket 44 is narrower than the head of the engaging bolt 64, except for the above-mentioned wider front part of the retaining hole 44*a* which is wider than the head of the engaging bolt 64. In mounting the roof unit RU onto the keyboard instrument main body KBU, the heads of the engaging bolts 64 are inserted into the wider front parts of the retaining holes 44*a* while the roof unit RF is moved from front to back by sliding the same on the side plates 41. Since the upper surfaces of the roof unit mounting brackets 44 are progressively lowered toward the back (see FIG. 2), the heads of the engaging bolts 64 are acted upon by a downwardly urging force by the upper surface parts of the roof unit mounting brackets 44 due to the engagement of the engaging bolts 64 and the retaining holes 44*a* as the roof unit RU is moved rearward, and as a result, the roof unit RU is pressed against the side plates 41.

Then, the roof unit RU is moved rearward until the fastening brackets 66 comes into abutment with the back surface 46. On this occasion, the front plate 62 of the roof unit RU also come into abutment with the abutment members 50 and 51. In this state, by fastening the fastening brackets 66 to the back surface 46 by screws, the roof unit RU is mounted onto the keyboard instrument main body KBU. The lower part 62*b* of the front plate 62 has monitoring speakers 68 (68L and 68R) incorporated therein (see FIG. 1B as well).

The music stand unit MSU is detachably attached to the upper surface 61*a* of the roof plate 61 (see FIG. 1B). As shown in FIG. 2, the music stand unit MSU is comprised of a mounting member 71, a fixing member 72, and a supporting member 73, as well as the musical score plate 79 of a collapsible type. As shown in FIG. 2, the musical score plate 79 is used in a standing position while being slightly tilted backward (hereinafter merely referred to as "the standing position") to hold the musical score 84 thereon. With the musical score plate to 79 in the standing position, the mounting member 71, the fixing member 72, and the supporting member 73 form a triangular shape as viewed from the side, and they constitute a musical score plate supporting device 70. As shown in FIG. 1A, a pair of musical score supporting devices 70 identical in construction with each other are arranged at right and left sides of the musical score plate 79. Therefore, a description will be given below of only one of the musical score supporting devices 70.

The musical score resting member 63 is provided with musical score pressers 80 (80L and 80R). As shown in FIG. 1A, the musical score pressers 80L and 80R are arranged laterally inward of both side edges of the musical score plate 79 in the transverse direction of the musical instrument.

Figure 3A:
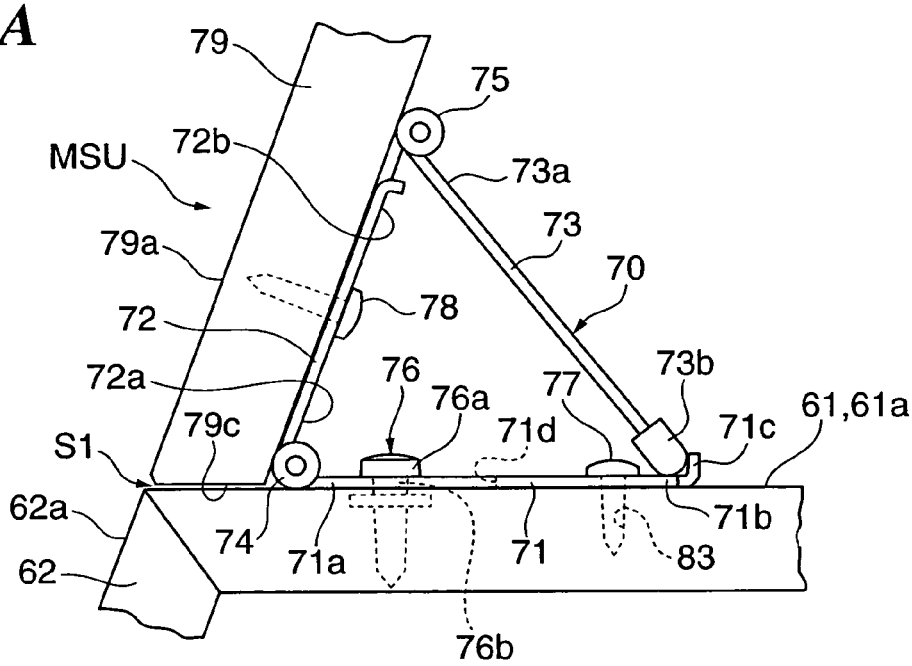
FIG. 3A is a side view showing essential parts of a music stand unit.
Figure 3B:
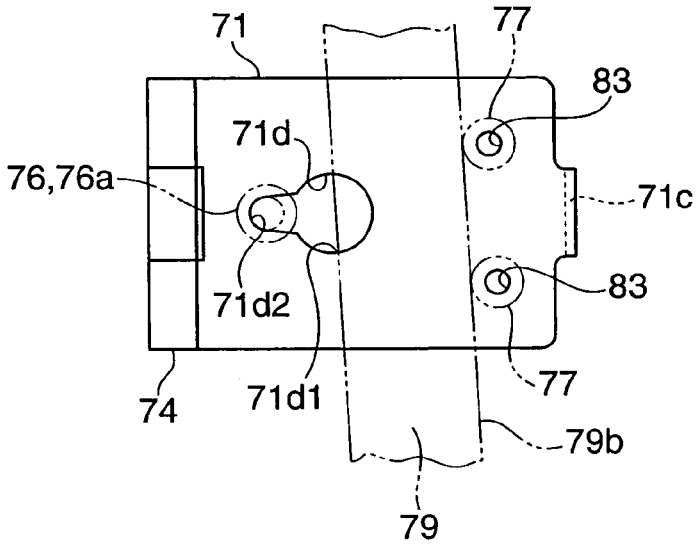
FIG. 3B is a plan view showing a mounting member for the music stand unit.
Figure 3C:
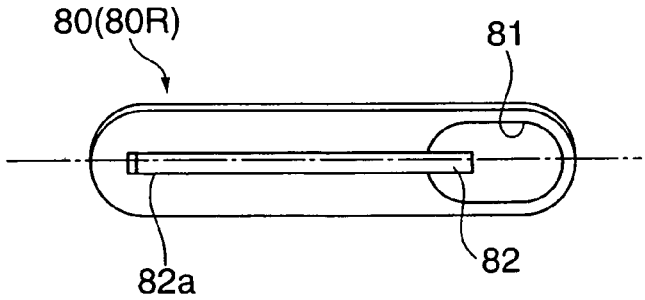
FIG. 3C is a plan view showing a musical score holding part of a musical score resting member of the roof unit.

FIGS. 3A is a side view showing essential parts of the music stand unit MSU, FIG. 3B is a plan view showing the mounting member 71, and FIG. 3C is a plan view showing the musical score presser 80 (80R). The musical score pressers 80L and 80R are symmetric with each other, and hence the construction of only the musical score presser 80R on the right side will be described with reference to FIG. 3C for the convenience of explanation.

First, as shown in FIG. 3A, in the musical score plate supporting device 70, one end 72*a* of the fixing member 72 and one end 71*a* of the mounting member 71 are pivotally supported by a rotary shaft 74, and the other end 72*b* of the fixing member 72 and one end 73*a* of the supporting member 73 are pivotally supported by a rotary shaft 75. An engaging section 71*c* that is bent upward is provided at the other end 71*b* of the mounting member 71. The fixing member 72 is fastened to a reverse side (rear surface) of the musical score plate 79 by screws 78. The mounting member 71 is fastened to the upper surface 61*a* of the roof plate 61 by an engaging bolt 76 and a screw 77. With this arrangement, the musical score plate 79 is able to rotate about the rotary shaft 74 relative to the roof plate 61. Also, the supporting member 73 is able to rotate about the rotary shaft 75 and supports the musical score plate 79 when a free end 73*b* of the supporting member 73 is engaged by the engaging part 71*c* of the mounting member 71. In this case, the musical score plate supporting device 70 is triangular in shape as viewed from the side, and the musical score plate 79 lies in the standing position.

The engaging bolt 76 is comprised of a neck 76*b* and a head 76*a* larger in diameter than the neck 76*b*, both projecting from the upper surface 61*a* of the roof plate 61, and the head 76*a* floating above the upper surface 61*a* by the length of the neck 76*b* is engaged with the roof plate 61. As shown in FIG. 3B, in the mounting member 71, an engaging through-hole 71*d* that is guitar-shaped in plan view is formed at a location corresponding to the engaging bolt 76. The engaging hole 71*d* is comprised of a larger hole 71*d*1 larger in diameter than the head 76*a* of the engaging bolt 76 and a smaller hole 71*d*2 having substantially the same diameter as the diameter of the neck 76*b* of the engaging bolt 76, the larger hole 71*d*1 and the smaller hole 71*d*2 being combined together. The larger hole 71*d*1 is located rearward of the smaller hole 71*d*2. Two tightening holes 83 for engaging the screws 77 with the upper surface 61*a* of the roof plate 61 are provided in the rear part 71*b* of the mounting member 71 at a location rearward of the engaging hole 71*d*.

The music stand unit MSU is attached to the roof unit RU after the roof unit RU is mounted onto the keyboard instrument main body KBU. The music stand unit MSU is mounted onto the roof unit RU in a manner described below.

First, the free end 73*b* of the supporting member 73 is engaged by the engaging part 71*c* of the mounting member 71, and with the musical score plate supporting device 70 remained in the triangular form as viewed from the side (i.e. with the musical score plate 79 being in the standing position), the head 76*a* of the engaging bolt 76 is passed through the larger hole 71*d*1 of the engaging hole 71*d* so that the mounting member 71 can be brought into abutment with the upper surface 61*a* of the roof plate 61. In this state, the music stand unit MSU is then slid rearward on the upper surface 61*a* to engage the neck 76*b* of the engaging bolt 76 in the smaller hole 71*d*2 of the engaging hole 71*d*. When the smaller hole 71*d*2 comes into abutment with the front side of the neck 76*b*, the smaller hole 71*d*2 and the neck 76*b* are brought into engagement with each other, so that the music stand unit MSU can be placed at a substantially appropriate position. The gap between the head 76*a* of the engaging bolt 76 and the upper surface 61*a* of the roof plate 61 is set to be substantially equal to the thickness of the mounting member 71, and as a result, when the smaller hole 71*d*2 and the neck 76*b* are brought into engagement with each other, the head 76*a* of the engaging bolt 76*a* serves to fix the mounting member 71 in place with ease.

Thereafter, the rear part 71*b* of the mounting member 71 is fastened and fixed to the roof plate 61 by the screws 77 through the fastening holes 83. This fastening operation is carried out by inserting a screwdriver into the head of each screw 77 from above and turning the screwdriver. Here, since the fastening holes 83 are located in the rear part 71*b* of the mounting member 71, an area located at the rearmost part of an upper rear edge 79*b* of the musical score plate 79 in the standing position lies substantially on vertical extensions L of the fastening holes 83 or the screws 77, as shown in FIG. 2.

Here, as shown in FIG. 1, the musical score plate 79 is shaped like a fan as viewed from the front. That is, the upper part of the musical score plate 79 is shaped like a circular arc as viewed from the front; the length of the musical score plate 79 in the vertical direction is greatest at the middle thereof in a lateral direction thereof and becomes smaller toward the right and left side edges when the musical score plate 79 is standing. Therefore, when the musical score plate 79 is brought into the standing position, the upper rear edge 79*b* of the musical score plate 79 is positioned closer to the front as it comes closer to the right and left side edges. Thus, as shown in FIG. 3B, as viewed from just above the fastening holes 83, the upper rear edge 79*b* of the musical score plate 79 lies well in front of the centers of the fastening holes 83. Therefore, as viewed from just above the fastening holes 83 or the screws 77, the musical score plate 79 never lies in the vicinity of the extensions L1.

For this reason, the rear part 71*b* of the mounting member 71 can be fastened to the roof plate 61 from above without interference between the screwdriver and the musical score plate 79 in tightening the screws 77. Thus, it is possible to attach the music stand unit MSU to the roof unit RU while holding the musical score plate 79 in the standing position without the need to temporarily raise it to the front. Further, since the musical score plate supporting devices 70 are arranged in the vicinity of the right and left sides of the fan-like musical score plate 79, the fastening holes 83 can be positioned at the foremost location possible while the screwdriver and the musical score plate 79 can be prevented from interference therebetween. That is, the depth or longitudinal size of the mounting member 71 can be set to be shorter. It is preferred that from the standpoint of facilitation of an operation for tightening the screws 77 using the screwdriver or the like, the fastening holes 83 are located well rearward of the rearmost part of the musical score plate 79 in the standing position.

The mounting members 71 and 72 are shaped in the form of a plate. The supporting member 73 is also plate-shaped but is configured such that with the free end 73*b* engaged by the engaging part 71*c* of the mounting member 71, the part of the supporting member 73 which is located just above the screws 77 is cut off to form a hollow part, so that the supporting member 73 never obstructs the operation of the screwdriver. It should be noted that the supporting member 73 may be comprised of a bar-like member insofar as it is configured to be away from or not to interfere with the screws 77.

Since the engaging hole 71*d* is located in the front part of the mounting member 71, and the fastening holes 83 are located in the rear part 71*b* of the mounting member 71, the mounting member 71 fastened to the roof plate 61 can be well balanced in the longitudinal direction thereof and therefore can be stable without wobbling or the like when acted upon by a force from the front or the back. Therefore, the musical score plate 79 can be kept in the standing position in a more stable state as compared with the case where the mounting member 71 is fastened to the roof plate 61 at only the rear part thereof (by only the screws 77).

Here, as shown in FIG. 3A, a lower end face 79*c* of the musical score plate 79 makes an acute angle to the front surface of the musical score plate 79 as a musical score holding surface 79*a*. When the musical score plate 79 lies in the standing position, the lower end face 79*c* of the musical score plate 79 and the upper surface 61*a* of the roof plate 61 are substantially parallel with each other, with a small space or gap S1 between them. Since the space S is small and there is no need to raise the musical score plate 79 to the front when fastening the mounting member 71 to the roof plate 61, a finger or foreign matter can never be caught in the space S1, and thus the music stand unit MSU can be safely attached to the roof unit RU with ease. Besides, making the space S1 small is advantageous in terms of design.

The musical score plate 79 can be laid down by releasing the supporting member 73 from its engagement by the engaging part 71*c* as shown in FIG. 2 where the musical score plate 79 (P1) and the supporting member 73 (P1) are shown in a laid-down state, as indicated by chain lines. In engaging or releasing the supporting member 73 with or from the engaging part 71*c*, it is necessary to raise the musical score plate 79 slightly to the front as indicated by chain lines in FIG. 2 showing the musical score plate 79 (P2) in the slightly raised position, but on this occasion, the amount of displacement required is so small that the space S1 can also be small. Since the space S1 is small, a finger or foreign matter can never be caught in the space S1 even when the musical score plate 79 is in a standing position or is laid down rearward.

When the musical score plate 79 lies in the standing position, the musical score holding surface 79*a* of the musical score plate 79 and the front surface 62*a* of the front plate 62 are flush with each other as shown in FIGS. 2 and 3A. The musical score holding surface 79*a* and the front surface 62*a* cooperate with each other to hold the back surface of the musical score 84 thereon. Therefore, the surface that holds the musical score from the back is flat without any stepped part, so that the musical score 84 can be held in an appropriate state. Besides, with the musical score 84 not placed, the appearance is good because the musical score holding surface 79*a* and the front surface 62*a* are flush with each other and the space S1 is small. Front end surfaces of the monitoring speakers 68 are also flush with the front surface 62*a* of the front plate 62, thus contributing to improvement in appearance.

As shown in FIG. 2, the musical score pressers 80 are incorporated in the musical score resting member 63. As shown in FIG. 3C, each musical score presser 80 is comprised of a finger hook concavity 81, and a musical score presser bar 82. The musical score presser bar 82 can turn in the transverse direction about a rotary part 82*a*, so that a free end-side part thereof can be positioned in a standing position or in a laid-down state. As mentioned above, the musical score resting member 63 increases in thickness toward the front to provide therein a space for accommodating the musical score pressers 80. Therefore, the musical score pressers 80 do not project downward from the musical score resting member 63, and the musical score pressers 80 can be easily arranged at such positions as to avoid interference with the cover 42. That is, by thus forming the musical score resting member 63 large in thickness, not only the musical score pressers 80 can be arranged inside the resting member 63 by making effective use of the space therein, but also the musical score resting member 63 can be attractive in terms of design since it presents an air of substance.

According to the present embodiment, the musical stand apparatus is configured such that with the musical score plate 79 held in the standing position, the music stand unit MSU is slid rearward to fit the neck 76*b* of the engaging bolt 76 into the smaller hole 71*d*2 of the engaging hole 71*d*, and the mounting member 71 is fastened to the roof plate 61 by the screws 77 through the fastening holes 83, and the space S1 between the lower end face 79*c* of the musical score plate 79 and the upper surface 61*a* of the roof plate 61 is set to be small. As a result, it is possible to securely mount the music stand unit MSU in a safe manner and with ease and to improve the appearance of the keyboard instrument 1.

Also, according to the present embodiment, when the musical score plate 79 lies in the standing position, the musical score holding surface 79*a* of the musical score plate 79 and the front surface 62*a* of the front plate 62 are flush which each other and cooperate with each other to hold the back surface of the musical score 84 thereon. Therefore, since the surface that holds the musical score from the back is flat without any stepped part, it is possible to hold the musical score 84 in an appropriate state and to improve the appearance of the keyboard instrument 1. Moreover, since the musical score resting member 63 is disposed at a level lower than the upper surface 61*a* of the roof plate 61, the musical score 84 can be held low so that it is easy to view.

Further, according to the present embodiment, the musical score resting member 63 is disposed at such a location as to bridge the rear part 42*a* of the cover 42 and the lower part 62*b* of the front plate 62 so as to not only perform the function of holding the musical score resting member 63 but also play a role of hiding the interior of the keyboard instrument main body KBU from view. Therefore, the cover 42 does not have to be long in the direction of the depth thereof, and hence the longitudinal size of the keyboard instrument main body KBU can be shortened in the keyboard instrument 1 equipped with the retractable slide cover 42. Also, as compared with the case where there is provided a member exclusively for hiding the interior of the keyboard instrument main body KBU from view, the construction can be simplified and is advantageous in terms of design, and hence the appearance can be improved.

Further, since the musical score pressers 80 are incorporated in the musical score resting member 63 that has an increased thickness, the musical score pressers 80 can be provided without interference with the cover 42. Therefore, it is possible to make effective use of the space in the musical score resting member 63 and to make the keyboard instrument 1 look attractive due to the increased thickness of the musical score resting member 63.

Although in the present embodiment, in mounting the music stand unit MSU, it is slid backward to fit the neck 76*b* of the engaging bolt 76 into the smaller hole 71*d*2 of the engaging hole 71*d*, the music stand unit MSU does not essentially have to be moved rearward, but it may be moved in a horizontal direction or in an oblique direction with the shape of the engaging hole 71*d* modified.

It should be noted that insofar as the reduction of the depth of the keyboard instrument main body KBU by enabling the musical score resting member 63 to perform the function of hiding the interior of the keyboard instrument main body KBU from view is concerned, the music stand unit MSU should not necessarily be provided. For example, the front surface 62*a* of the front plate 62 may be extended so that the front surface 62*a* alone can hold the back surface of the musical score 84 thereon.

Although the musical score plate 79 is brought into a standing position by engaging the free end 73*b* of the supporting member 73 with the engaging part 71*c* of the mounting member 71, the free end 73*b* should not necessarily be engaged by the engaging part 71*c* provided at the other end 71*b* of the mounting member 71 but has only to be engaged by another part of the mounting member 71.

The engaging bolt 76 and the engaging hole 71*d* should not essentially be comprised of the head 76*a*, the neck 76*b*, the larger hole 71*d*1, and the smaller hole 71*d*2, but have only to be a combination of an engaging part shaped like a hook or the like and an engaged part associated therewith insofar as they can perform the function of temporarily fixing the mounting member 71 in place, and also more preferably the function of temporarily positioning the mounting member 71.

It should be noted that the fastening means for fastening the mounting member 71 to the roof plate 61 is not limited to the fastening holes 83, and the fastening fixture is not limited to the screws 77.

What is claimed is:

1. A music stand device for a musical instrument, comprising:

a music score plate that holds a musical score on a musical score holding surface thereof while being tilted backward in a standing position;

a mounting member mountable on a roof plate of the musical instrument, and having one end;

a fixing member fixed to said musical score plate and having one end thereof rotatably supported by the one end of said mounting member, said fixing member having another end;

a supporting member having one end thereof rotatably supported by the other end of said fixing member and having another end thereof engaged by a part of said mounting member to thereby maintain said musical score plate in the standing position; and an engaging member that is provided in the roof plate in opposed relation to said mounting member, wherein said musical score plate has a lower end surface thereof in the standing position thereof disposed at an acute angle to the musical score holding surface, and said mounting member comprises an engaged part provided in association with said engaging member and engageable with said engaging member to temporarily fix said mounting member to the roof plate, and at least one fastening part provided in a rear part of said mounting member at a location rearward of said engaged part, for fastening said mounting member to the roof plate by a fastening tool, and said mounting member is slid while said musical score plate is held in the standing position, to engage said engaged part and said engaging member with each other, and then said mounting member is fastened to the roof plate by the fastening tool from above through said fastening part.

2. A musical instrument having a music stand device, comprising:

a roof plate having a front part;

a front plate extending aslant, i.e. forward and downward from the front part of said roof plate, said front plate having a front surface; and a musical score plate provided in the music stand device, said musical score plate being mounted in a standing position on the front part of said roof plate, said musical score plate having a front surface; and a musical score resting member provided at a lower level than said roof plate, for holding a lower end of a musical score, wherein the front surface of said front plate and the front surface of said musical score plate are flush with each other and cooperate with each other to hold a back surface of the musical score, and said musical score resting member holds the lower end of the musical score in such a manner that a lower end of the music score is disposed at a level lower than an upper surface of said roof plate.

3. A musical instrument according to claim 2, wherein said musical score resting member has a musical score abutment surface on which the musical score is to abut, and wherein said musical score abutment surface is disposed substantially at right angles to the front plate to prevent slippage of the musical score.

4. A musical instrument having a music stand device, comprising:

a retractable slide cover that is opened and closed by sliding forward and backward, said retractable slide cover having a rear part;

a roof plate having a front part;

a front plate extending aslant, i.e. forward and downward from the front part of said roof plate, said front plate having a lower part; and a musical score resting member, provided at such a location as to bridge the rear part of the retractable slide cover and the lower part of said front plate when said retractable slide cover is closed, for holding a lower end of a musical score in such a manner that the lower end of the music score is disposed at a level lower than an upper surface of said roof plate.

5. A musical instrument according to claim 4, wherein said musical score resting member has a musical score abutment surface on which the musical score is to abut, and wherein said musical score abutment surface is disposed substantially at right angles to the front plate to prevent slippage of the musical score.

6. A music stand device for a musical instrument, comprising:

a music score plate that holds a musical score on a musical score holding surface thereof while being tilted backward in a standing position;

a mounting member mountable on a roof plate of the musical instrument, and having one end;

a fixing member fixed to said musical score plate and having one end thereof rotatably supported by the one end of said mounting member, said fixing member having another end;

a supporting member having one end thereof rotatably supported by the other end of said fixing member and having another end thereof engaged by a part of said mounting member to thereby maintain said musical score plate in the standing position; and an engaging member that is provided in the roof plate in opposed relation to said mounting member, wherein said musical score plate has a lower end surface thereof in the standing position thereof disposed at an acute angle to the musical score holding surface, and said mounting member comprises an engaged part provided in association with said engaging member and engageable with said engaging member to temporarily fix said mounting member to the roof plate, and at least one fastening part provided in a rear part of said mounting member at a location rearward of said engaged part, for fastening said mounting member to the roof plate by a fastening tool, and said mounting member is slid while said musical score plate is held in the standing position.

* * * * *